United States Patent [19]

Araki

[11] Patent Number: 4,790,678

[45] Date of Patent: Dec. 13, 1988

[54] MECHANISM FOR EXTRUDING AND RETRACTING A WRITING MEMBER OF A WRITING INSTRUMENT

[75] Inventor: Toshio Araki, Aichi, Japan

[73] Assignee: Pilot Ink Co., Ltd., Nagoya, Japan

[21] Appl. No.: 66,276

[22] Filed: Jun. 25, 1987

[30] Foreign Application Priority Data

Jun. 25, 1986 [JP] Japan ..... 61-97486[U]
Aug. 29, 1986 [JP] Japan ..... 61-133105[U]

[51] Int. Cl.[4] ..... B43K 24/04; B43K 24/12

[52] U.S. Cl. ..... 401/104; 401/106; 401/109

[58] Field of Search ..... 401/104–106, 401/109; 24/11 P

[56] References Cited

U.S. PATENT DOCUMENTS

| | | | |
|---|---|---|---|
| 2,427,069 | 9/1947 | Randolph | 401/104 |
| 2,583,142 | 1/1952 | Frentzel | 401/106 |
| 2,988,055 | 6/1961 | Platt | 401/112 |
| 3,071,112 | 1/1963 | Lovejoy et al. | 401/112 |
| 3,179,088 | 4/1965 | Johmann | 401/110 |
| 3,203,402 | 8/1965 | Lockwood | 401/106 |

FOREIGN PATENT DOCUMENTS

| | | | |
|---|---|---|---|
| 450916 | 7/1936 | United Kingdom | 401/109 |
| 663140 | 12/1951 | United Kingdom . | |
| 1426817 | 3/1976 | United Kingdom . | |
| 1507351 | 4/1978 | United Kingdom . | |

*Primary Examiner*—Richard J. Apley
*Assistant Examiner*—Franklin L. Gubernick
*Attorney, Agent, or Firm*—Sughrue, Mion, Zinn, Macpeak, and Seas

[57] ABSTRACT

A mechanism for extruding and retracting the writing member of a writing instrument which is set ready for writing by pressing a clip member vertically movable in a slit bored in the rear side wall of a cylinder, but held in a protruded state while the writing instrument is not set for writing. The clip member presses a flexible working element arranged under the clip member and having a plurality of elastic zigzag bent portions. The working element thus pressed down axially extends to press the back of the writing member contained in the front part of the cylinder and energized backward by spring action and moves the writing member forward. The tip of the writing member is protruded from the opening at the front end of the cylinder and the clip holder of the clip member is held inside the slit during writing. On the other hand, the clip member is released from pressing the bent portions so as to restore the flexible working element to the bent condition in the original position and the clip holder of the clip member is again protruded from the side wall of the cylinder to place the writing instrument in the non-writing state.

8 Claims, 4 Drawing Sheets

MECHANISM FOR EXTRUDING AND RETRACTING A WRITING MEMBER OF A WRITING INSTRUMENT

BACKGROUND OF THE INVENTION

1. Field of the Invention

The present invention relates to retractable pens, pencils and similar writing instruments.

2. Background of the Invention

The present invention relates to a mechanism for extruding and retracting the writing member of a writing instrument of the kind having such a writing member contained in the front part of a cylinder and energized backward by a spring between the front of the cylinder and the writing member. The writing instrument has a working element contained in the rear part of the cylinder used to press the back of the writing member to move the writing member forward. Such a writing instrument is set for writing by pressing a clip member to actuate the working element, which in turn moves the writing member forward to protrude the tip of the writing member from the opening of the cylinder. The writing instrument is restored to the non-writing condition by releasing the clip member from being pressed to retract the writing member into the cylinder.

Japanese Utility Model No. 5657/72 contains a disclosure of an extruding/retracting mechanism for use in an writing instrument wherein it has been so arranged that a writing member contained in a cylinder can be retracted by pressing a clip member fitted to the cylinder.

The aforesaid extruding/retracting mechanism is assembled so that the base of the clip member is fastened with a pin in the cylinder and is movable with the pin as a fulcrum. Further, an inclined cam surface is mated with the incline of a dowel fitted to the rear end of the writing member. In operation, the front end of the clip member is radially depressed to press the incline of the dowel, which slides forth to move the writing member forward. The top face at the front end of the base of the clip member is caused to abut against and mate with the top face at the rear end of the dowel beyond the incline of the dowel in order to make the writing member ready for writing. On the other hand, the rear end of the clip member is radially depressed downward and simultaneously its front end is lifted to release the above described mated state to move back the writing member so as to restore the writing member to the non-writing condition.

In the conventional extruding/retracting mechanism, the stroke causing the writing member to axially move forward is dependent on the length of the incline of a cam at the front end of the base and therefore there is a limit upon extending the moving stroke. Accordingly, the writing member has to move back and forth within a short stroke. While the writing member contained in the cylinder is in the non-writing condition, the front end of the writing member is held close to the opening at the end of the front end of the cylinder. Then if the writing member for use is a ball-point pen, marker or the like, the drying-up of the tip of the writing member or the contamination thereof because of foreign substances as dust sticking thereto tends to cause trouble. Moreover, since the top face at the front end of the base is attached to that at the rear end of the dowel to maintain the writing member in the writing condition, a sufficient contact area is unavailable. Because not only its resistance to the applied writing pressure but also its practical long-term utility is poor, its durability is unsatisfactory.

Further, as the writing member is extruded and retracted by moving up and down the clip member with the pinned spot as a fulcrum in the aforesaid mechanism, the stress is concentrated in the location of the pinn and the writing member does not demonstrate practical durability when used repeatedly.

SUMMARY OF THE INVENTION

The present invention is intended to remedy the drawbacks characteristic of conventional mechanisms. Therefore, it is an object of the present invention to provide a mechanism for extruding and retracting the writing member of a writing instrument, the forward and rearward moving strokes of the writing member contained in a shaft cylinder being set effectively long within the limited length of the cylinder to thereby prevent the trouble caused by the drying up or contamination of the tip of the writing member while it is retracted and contained in the cylinder.

In other words, unless the clip holder of a clip member is contained within the cylinder, the writing member is not set for writing. Likewise, unless the writing member is completely drawn into the cylinder, the clip holder of the clip member is not lifted nor used to perform the clipping function to ensure that clothes are prevented from being stained with ink oozing out of the writing member fastened in a pocket while it unintentionally remains in the cylinder.

In addition, a relatively light load applied to the clip member is sufficient to move the writing member forward, whereas the writing member is made retractable by simple means. Consequently, it is ensured that the extruding/retracting mechanism according to the present invention practically withstands repeated use to the satisfaction of desired simplicity, durability and workability in operation.

The writing instrument of the invention comprises a writing member in a cylinder and a mechanism for extruding and retracting the writing instrument. A pocket clip can project through a slot in the cylinder. An elastic zigzag working element biases the clip radially outward and biases the writing member axially outward. A cam tube guides the clip in its movement. The clip is locked in a lower position to keep the writing member extended.

DETAILED DESCRIPTION OF THE PREFERRED EMBODIMENT

Figure 1:
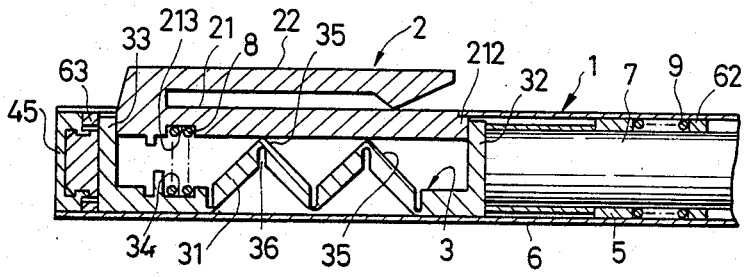
FIG. 1 is a vertical sectional view of the principal part of a writing instrument in a non-writing state.

Referring now to the drawings, the mechanism for extruding and retracting the writing member of a writing instrument according to the present invention will be described.

A first embodiment of the present invention will be described with reference to FIGS. 1 through 7.

Figure 7:
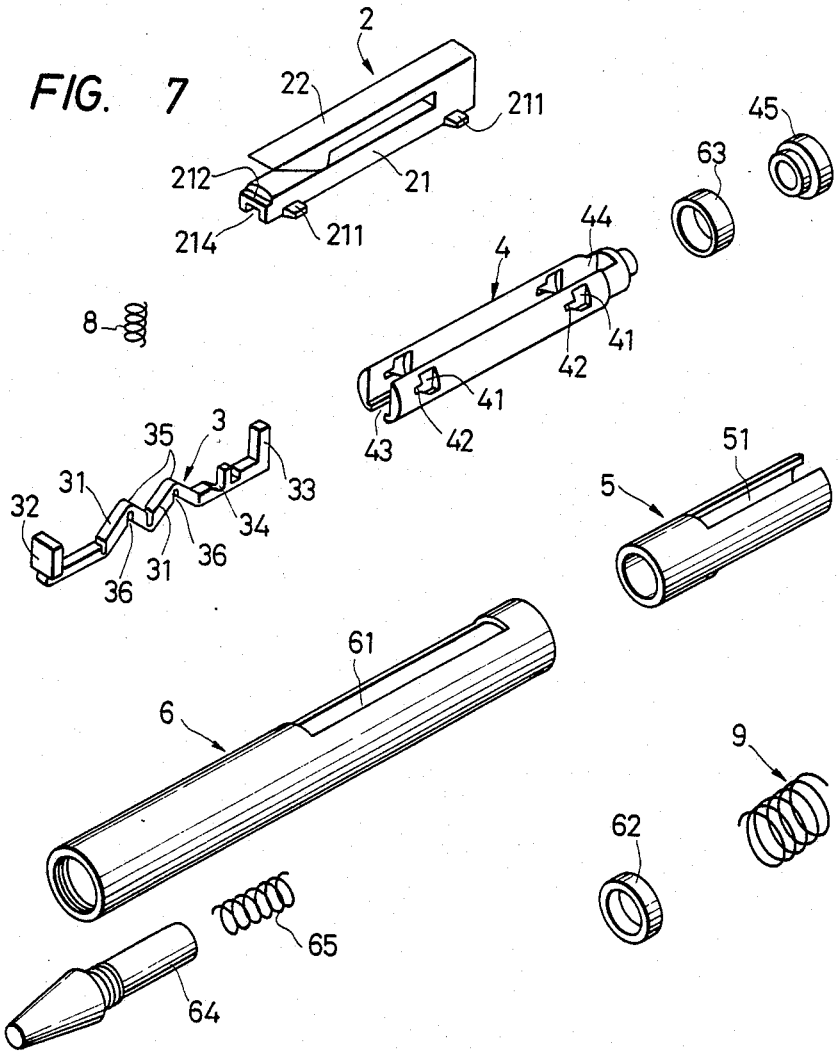
FIG. 7 is an exploded perspective view of a component part.

A clip member 2 consists of a base 21 and a clip holder 22, both being coupled at one end of the base 21. The outer face of the front end of the base 21 is cut away, as shown in FIG. 7, in the form of a step and is thus provided with a mating portion 212. Two pairs of mating projections 211 are provided oppositely at a proper interval on both sides of the base 21. A slide groove 214 is provided axially in the rear surface of the base 21. The slide groove 214 causes the bent portions 35 of a flexible working element 3 to slide. A recessed spring seat 213 is located at the foot of the rear surface of the base 21. The spring seat 213 may be, as occasion demands, provided in two places at suitable intervals.

Figure 16:
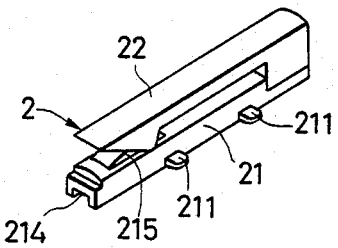
FIG. 16 is a perspective view of another clip member.

Moreover, the clip member 2 is not limited to what is shown in FIG. 7, but, as shown in FIG. 16, may be so constructed as to effectively prevent the clip holder 22 from transversely deflecting. This prevention is accomplished by bending both sides of the front end of the clip holder 22 is parallel to form a clip portion and by providing a projection 215 positioned on the surface of the base 21 and opposite to the underside of the clip portion.

The flexible working element 3 (FIG. 7) is formed with a plurality of zigzag bent portions 35 made of plastic or metal material. A cut groove 36 is made in the inner side of each bent portion 35 to improve its bending properties. The flexible working element 3 includes expansion parts 31 on each side of the bent portion, a press part 32 projecting radially on one end and a mating part 33 projecting radially on the other end. The press part 32 always abuts the rear of the rearwardly biased writing member 7. A recess 34 is provided close to the mating part 33 and a coil spring 8 for resiliently lifting the clip member 2 is fitted into the recess 34. In the case of a flexible working element 3 itself formed with metal spring plates, it is not always necessary to install the coil spring 8 between the spring seat 213 and the recess 34 so that these two latter elements can also be eliminated.

A cylinder 6 forms the main exterior structure of the writing instrument and has a hollow tip 64 screwed into its front. A compression spring 65 is fitted into the tip 64 and has its other end engaging a shoulder of a writing member 7 (e.g., a pen refill) so as to always bias it backwards.

A cam tube 4 includes an axial slit 44 on its top for receiving the clip member 2 and a slide groove 43 on its bottom opposite the slit 44 for guiding and sliding the working element 3. In the opposite positions on both side walls of the cam tube 4 are cam holes 41 for receiving the mating projections 211 of and guiding the clip member 2 upward and downward. Mating recesses 42 are formed on front sides of all the cam holes 41 for receiving the mating projections 211. When the spring 9 biases the cam tube 4 backwardly when the projection 211 of the clip member 2 are below the level of the top of the recesses 42, the clip member 2 is locked in a depressed position. Thereby, the working element 3 is compressed and its press part 32, pressing against the back of the writing member 7, extrudes the writing member 7 and prevents the writing member 7 from moving back so as to hold the writing member 7 in the writing condition. The rear end of the cam tube 4 is formed into a smaller-diameter cylinder and a button 45 is rigidly fitted therein. The button 45 may be such that the cam tube 4 is extended to integrally form the button 45. The button 45 is used to set the writing member 7 for writing by protruding into the rear end of the cylinder 6 to abut against and move the cam tube 4 forward. The button 45 also sets the writing member 7 in the non-writing condition by pressing forward the cam tube 4, thereby releasing the mating projections 211 from engaging with the mating recesses 42 so that the clip member 2 is automatically lifted by spring force to move back the writing member 7 by the now unopposed biasing of spring 65.

A guide tube 5 has a slide groove 51 for receiving and guiding the press part 32 of the working element 3 in the rear axial direction. The writing member 7 extends through the guide tube 5 to abut against the press part 32 wherever it is located in the guide tube slide groove 51. The back of the guide tube 5 abuts the front of the cam tube 4.

A stopper 63 is press fitted or fixed onto the inside of the rear end of the cylinder 6 and prevents the cam cylinder 4 from escaping the rear of the cylinder 6 and also sandwiches the mating part 33 of the working element 3 between it and the clip member 2. A stopper 62 is fixed internally to a lower middle portion of the cylinder 6 with the spring 9 disposed between it and the front end of the guide tube 5.

A brief description will subsequently be given of a procedure for assembling the principal components. The procedure comprising the steps of inserting the working element 3 in the slide groove 43 of the cam tube 4; fitting the matching projections 211 of the clip member 2 into the cam holes 41 of the cam tube 4; placing the coil spring 8 between the recessed spring seat 213 of the clip member 2 and the recess 34 of the working element 3; causing the guide tube 5 inserted at the back of the stopper 62 fixed to the back of the writing member 7 contained in the front part of the cylinder 6 with the spring 9 therebetween to abut against the working element 3; inserting the cam cylinder 4 containing the working element 3 into the cylinder 6; and making the mating part 33 of the working element 3 abut against the stopper 63.

Figure 2:
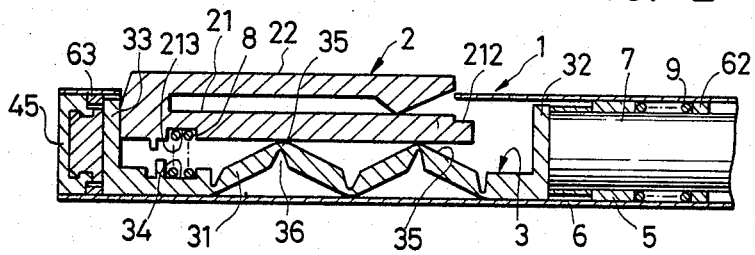
FIG. 2 is a vertical sectional view of the principal part thereof in a intermediate operating state.
Figure 3:
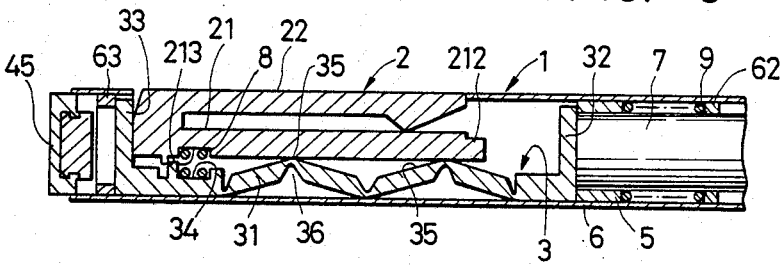
FIG. 3 is a vertical sectional view of the principal part thereof in the writing state.
Figure 4:
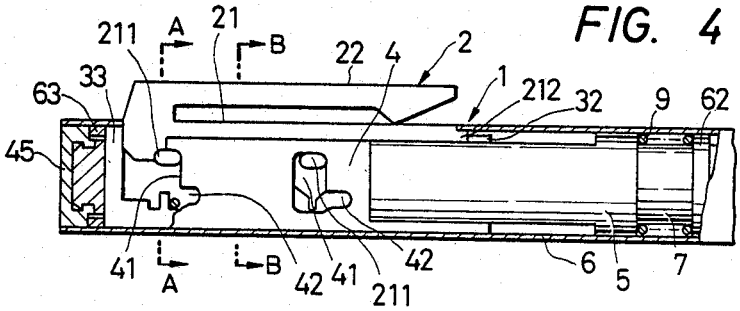
FIG. 4 is a partial cutaway sectional view of the shaft cylinder and the cam tube in the non-writing state.
Figure 5:
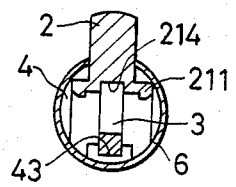
FIG. 5 is a sectional view taken on line A—A of FIG. 4.
Figure 6:
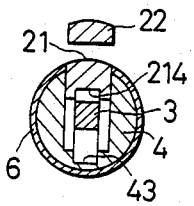
FIG. 6 is a sectional view taken on line B—B of FIG. 4.

The operation will be described as follows:

When the clip member 2 is pressed down, the bent portions 35 of the working element 3 are pressed and are thus extended axially forward. As the press part 32 of the working element 3 is moved forward, the clip member 2 gradually recedes into the cylinder 6 (FIG. 2). When the mating projections 211 of the clip member 2 are then moved up to the positions of the mating recesses 42, the cam tube 4 is moved back by the rearward bias of the spring 9 against the cylinder 6 as transmitted through the guide tube 5. Because the guide tube 5 is being continually pressed backward by the spring 9, the button 45 is caused to protrude from the rear end of the cylinder 6 (FIG. 3). Simultaneously, the mating projections 211 engaging with the upper surface of mating recesses 42 push the press part 32 of the working element 3 forward to provide the writing member 7 with maintenability sufficient to resist the writing pressure so that the writing member 7 set for writing can be put to practical stable use without rocking.

When the button 45 is pressed in the aforesaid writing condition (FIG. 3), the cam tube 4 is moved forward with respect to the cylinder 6 and the clip member 2 and thereby the mating projections 211 are released from engaging with the mating recesses 42 (FIG. 4) so that the clip member becomes free to move upwardly. At this time, the working element 3 is contracted axially as the writing member 7 moves back because the writing member 7 is kept being energized backward by the spring 65 in the front portion of the cylinder. Thereby the working element 3 thrusts up the clip member 2 with the force of pushing up the clip member 2 applied by the bent portions 35 together with the recoiling force of the coil spring 8 and protrude the clip holder 22 through the side wall of the cylinder 6 (FIG. 1). Since the clip member 2 thus protruded is supported with the bent portions 35 and the coil spring 3, it is held in a stable protruded condition.

Referring to FIGS. 8 through 15, another embodiment of the present invention will be described.

Figure 8:
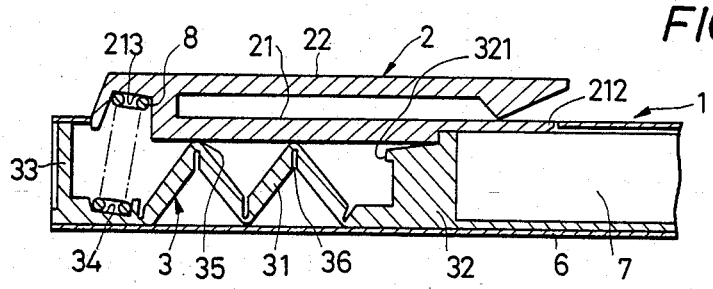
FIG. 8 is a vertical sectional view of the principal part of another writing instrument in the non-writing state.
Figure 9:
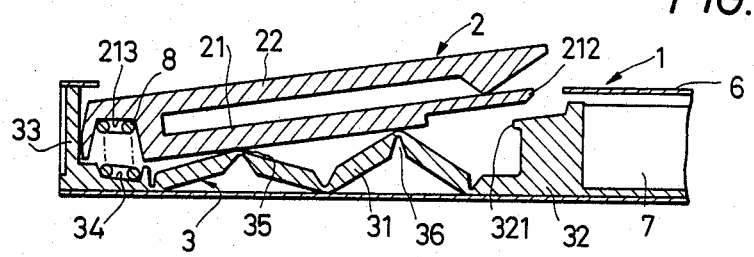
FIG. 9 is a vertical sectional view of the principal part thereof in the intermediate operating state.
Figure 10:
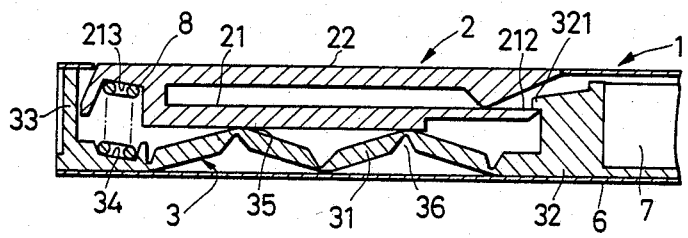
FIG. 10 is a vertical sectional view of the principal part thereof in the writing state.
Figure 11:
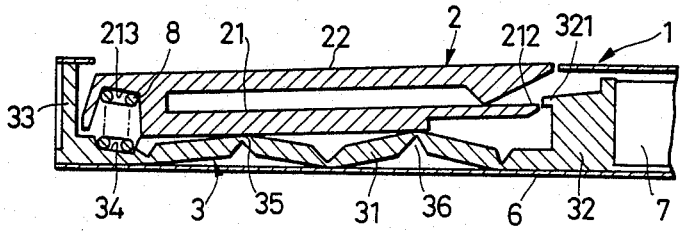
FIG. 11 is a vertical sectional view of the principal part in the intermediate state at reset time.
Figure 12:
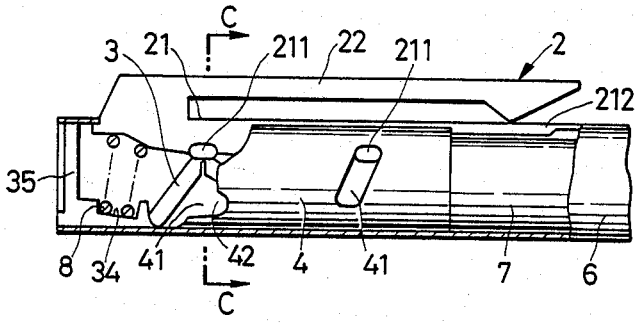
FIG. 12 is a partial cutaway sectional view of the shaft cylinder and the cam tube in the non-writing state.
Figure 13:
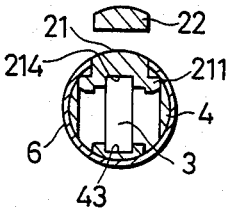
FIG. 13 is a sectional view taken on line C—C of FIG. 12.
Figure 14:
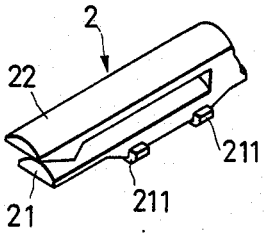
FIG. 14 is a perspective view of the clip member.
Figure 15:
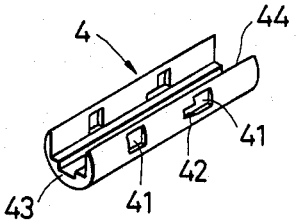
FIG. 15 is a perspective view of the cam tube.

A clip member 2 is vertically movably arranged in a slit 61 (FIG. 7) provided in the rear side wall of a shaft cylinder 6. In a non-writing condition (FIG. 8), a clip holder 22 is kept protruded. Opposite mating projections 211 fitted to both side of the base 21 of the clip member 2 are slidably engaged with cam holes 41 in a tubular cam 4 press-fitted in a cylinder 6. A flexible working element 3 fitted into the tubular cam 4 is installed under the base 21. The flexible working element 3 has bent portions 35 abutting against the back of the base 21. A coil spring 8 is arranged between a recessed spring seat 213 of the base 21 and a recess 34 of the working element 3. A press part 32 of the working element 3 has at a rear end a mating collar 321. The bent portions 35 are pressed down by depressing the clip member 2 into the cylinder 6 and are thus extended axially forward to force a writing member 7 to move forth and protrude from the front opening of the cylinder 6. In that protruded state, the mating part 212 of the base of the clip member 2 is caused to come down over and to mate with the mating collar 321 to set the writing member for writing (FIG. 10). When the clip member 2 in the writing condition is pressed again to release the mating part 212 from engaging with the mating collar 321, the clip member 2 is biased upward by the coil spring 8 and the bent portions 35 of the working element 3. Thus, the clip holder 22 is protruded from the side wall of the cylinder 6, so that the writing member 7 is returned to the non-writing position (FIG. 8).

The operation of the mechanism for extruding and retracting the writing member of a writing instrument thus constructed according to this embodiment will be described.

When the clip member 2 is pressed down, the working element 3 is extended axially forward. As the press part 32 moves forward, the clip member 2 is gradually recessed into the shaft cylinder 6. The mating part 212 of the clip member 2 is then engaged with the mating collar 321 of the press part 32. When the mating projections 211 of the clip member 2 are fitted into mating recesses 42 of two of the cam holes 41, the mating recesses 42 provide the writing member 7 with maintenability sufficient to resist the writing pressure and allows the writing member stable writing condition (FIG. 10).

When the clip member 2 in the writing condition is pressed again, it moves down in a non-parallel from (FIG. 9), causing the working element 3 to extend. Consequently, the mating part 212 is released from engaging with the mating collar 321 and simultaneously the mating projections 211 are also released from engaging with the mating recesses 42 of the cam holes 41. At this time, the working element 3 is contracted by the stress applied by the writing member 7 in the backward direction as the writing member 7 moves back. The writing member 7 is energized backward by the spring means in the front portion of the cylinder. When the force applied to the clip member 2 is released, the coil spring 8 is caused to push up the clip member 2 and the clip holder 22 is protruded from the cylinder 6. Accordingly, the clip member 2 is supported by the bent portions 35 of the working element 3 and by the coil spring 8 and is stably kept protruded from the side wall of the cylinder 6.

The mechanism for extruding and retracting the writing member of a writing instrument according to the present invention meets the following requirements. A flexible working element 3 having a plurality of zigzag bent portions 35 is installed under a vertically movable clip member 2 arranged in the slot 61 bored in the rear side wall of a shaft cylinder. When the clip member 2 is pressed and moved down, the clip member 2 presses the bent portions 35 of the working element 3 and forces the bent portions 35 to extend axially forward, thus causing the working element 3 to push the back of and move forward a writing member 7. Thereby the clip holder 22 of the clip member 2 is recessed and into the shaft cylinder is held in the slot 61 to set the writing member 7 ready for writing. On the other hand, the clip member 2 is released from pressing the working element 3 so that the zigzag bent portions 35 are reformed and the clip holder 22 of the clip member 2 is projected from the side wall of the cylinder, whereby the writing member is placed in a non-writing condition. More specifically, the clip member 2 consists of the base 21 having mating projections 211 on both sides and the clip holder 22 integral with the base 21. The flexible working element 3 is installed in the cam tube 4 having an axial slit 44 for receiving the clip member 2 and cam holes 41 in the side walls. The cam holes 41 engage with the mating projections 211 and guide the clip member 2 upward and downward. The slit 44 of the cam tube 4 is positioned opposite to these lot 61 of the cylinder so as to make the rear surface of the base 21 of the clip member 2 abut against the bent portions 35 of the working element 3 and to make the mating projections 211 engage with the cam holes 41. In the non-writing condition, the clip holder 22 is protruded from the side wall of the cylinder by spring means attached to and used to energize the flexible working element 3.

What is claimed is:

1. A writing instrument, comprising:

a cylinder;

a writing member contained in said cylinder and biased backwards against a front of said cylinder;

a clip member radially pressable through said cylinder and having a base equipped with mating projections on both sides thereof and a clip holder arranged in a slot of said cylinder;

a flexible working element contained in said cylinder and pressable against a back of said writing member to move said writing member forward, said working element having a plurality of flexing zigzag portions positioned under said base and having a fixed rear portion, wherein a pressing of said clip member causes said working element to move said writing element forward to protrude from a front opening of said cylinder and a releasing of said clip member causes a retraction of said writing member from said front opening; and a cam tube fitted with said working element and having an axial slit being arranged opposite said slot of said cylinder for receiving said clip member and having in side walls cam holes for engaging with said mating projections and for guiding an elevation of said clip member.

2. A writing instrument of claim 1, further comprising spring means biasing said clip member so as to protrude said clip holder out of said slot of said cylinder, said spring means operating to cause said writing member to assume an axial non-writing position.

3. A mechanism as claimed in claim 2, wherein said spring means comprises a coiled spring held between a recessed spring seat in back of an end of said base of said clip member and a recess of said flexible working element disposed opposite said spring seat.

4. A mechanism as claimed in claim 3, wherein said spring means comprises said flexible working element, said flexible working element being composed of a leaf spring material.

5. A mechanism as claimed in claim 1, wherein said base of said clip member includes on an inner side a slide groove for causing said bent portions of said flexible working element to slide axially.

6. A mechanism as claimed in claim 1, wherein said flexible working element includes cut grooves formed on insides of said bent portions thereof.

7. A mechanism as claimed in claim 1, wherein said cam tube is axially slidable in said cylinder and wherein said cam holes comprise respective recesses at forward, lower portions thereof for engaging said mating projections of said clip member.

8. A mechanism as claimed in claim 7, further comprising biasing means for biasing said cam tube rearwardly of said cylinder.

* * * * *